United States Patent [19]

Ellingsen

[11] Patent Number: 4,884,634

[45] Date of Patent: Dec. 5, 1989

[54] PROCESS FOR INCREASING THE DEGREE OF OIL EXTRACTION

[75] Inventor: Olav Ellingsen, Florø, Norway

[73] Assignee: Industrikontakt Ing. O. Ellingsen & Co., Floro, Norway

[21] Appl. No.: 84,793

[22] PCT Filed: Dec. 3, 1986

[86] PCT No.: PCT/NO86/00080

§ 371 Date: Jul. 8, 1987

§ 102(e) Date: Jul. 8, 1987

[87] PCT Pub. No.: WO87/03643

PCT Pub. Date: Jun. 18, 1987

[30] Foreign Application Priority Data

Dec. 3, 1985 [NO] Norway ..... 854852

[51] Int. Cl.[4] ..... E21B 43/25

[52] U.S. Cl. ..... 166/248; 166/249

[58] Field of Search ..... 166/248, 249, 65.1, 166/177; 219/277, 278

[56] References Cited

U.S. PATENT DOCUMENTS

| | | | |
|---|---|---|---|
| 2,670,801 | 3/1954 | Sherborne | 166/21 |
| 2,799,641 | 7/1957 | Bell | 166/249 X |
| 3,141,099 | 7/1964 | Brandon | 166/248 X |
| 3,169,577 | 2/1965 | Sarapuu | 166/42 |
| 3,378,075 | 4/1968 | Bodine | 166/45 |
| 3,503,466 | 3/1970 | Rosander | 182/13 |
| 3,507,330 | 4/1970 | Gill | 166/248 |
| 3,547,192 | 12/1970 | Claridge | 166/248 |
| 3,718,186 | 2/1973 | Brandon | 166/248 |
| 3,754,598 | 8/1973 | Holloway | 166/249 |
| 3,874,450 | 4/1975 | Kern | 166/65.1 X |
| 3,920,072 | 11/1975 | Kern | 166/248 |
| 3,952,800 | 4/1976 | Bodine | 166/249 |
| 3,970,146 | 7/1976 | Keenan | 166/249 |
| 4,049,053 | 9/1977 | Fisher et al. | 166/249 |
| 4,060,128 | 11/1977 | Wallace | 166/249 |
| 4,084,638 | 4/1978 | Whiting | 166/248 |
| 4,252,189 | 2/1981 | Bodine | 166/249 |
| 4,437,518 | 3/1984 | Williams | 166/248 |
| 4,466,484 | 8/1984 | Kermabon | 166/60 |
| 4,525,263 | 6/1985 | Parkhurst et al. | 166/248 X |

FOREIGN PATENT DOCUMENTS

| | | | |
|---|---|---|---|
| 2517361 | 6/1983 | France . | |
| 298432 | 4/1971 | U.S.S.R. . | |
| 832072 | 5/1981 | U.S.S.R. | 166/249 |
| 927983 | 5/1982 | U.S.S.R. . | |
| 1086131 | 4/1984 | U.S.S.R. . | |

*Primary Examiner*—Bruce M. Kisliuk

*Attorney, Agent, or Firm*—Ladas & Parry

[57] ABSTRACT

A process for increasing the degree of extraction of oil or other volatile liquids in oil reservoirs on land or at sea, by making the formations in said reservoir vibrate as close to the natural frequency of said formations as possible, so that the binding forces between formations and oil are degraded and oil is, thus, more easily recovered from the formations. Furthermore, the pressure in said reservoir is maintained by evaporating some oil and water in the reservoir, due to the fact that heating is achieved both as a consequence of said vibrations, and by the aid of electrical high frequeny pulses causing the reservoir to perform like an electrode furnace.

4 Claims, 4 Drawing Sheets

PROCESS FOR INCREASING THE DEGREE OF OIL EXTRACTION

The present invention relates to a process for increasing the degree of extraction for oil or other volatile liquids in oil reservoirs on land or at sea by the aid of vibrations and heat by the aid of electrical high-frequency pulses.

In connection with recovery of oil from any oil field only part of the oil present can be recovered. The degree of recovery can vary from approximately 17% and up to approximately 50%. The degree of recovery from the EKOFISK field is, e.g. estimated at approximately 20%.

The cause of the fact that it is not possible to recover all oil from a field, or at least a larger portion of such oil, is involved with the manner in which oil is bound in the formations. Oil in the pores of the formations is bound to said formations by capillary forces, surface tensions, polar forces, and adhesive forces. At the beginning of oil production said binding energy will be overcome by the natural pressure prevailing in said oil reservoirs, but as this pressure gradually decreases said forces will exceed the expelling pressure, resulting in a decreased oil production even though most of the oil is left in the formations.

Considerable effort was made over the years and is still made to increase the degree of recovery, and the best known approach is to inject water into the reservoirs. Additionally, a series of chemicals was developed, all of them more or less intended for breaking up the adhesion forces between oil and formations. Besides being very expensive the known methods only contribute very little to increase the degree of recovery. E.g., the above mentioned degree of recovery is calculated after injection of water into the reservoir. Without such injection the degree of recovery is calculated to be approximately 17%.

Apart from the fact that a relatively small increase of the degree of recovery is achieved, water injection requires extensive control of injection wells. This is associated with the so called "finger problem" arising when water penetrates. The water front moving in the oil field will not appear as a sharp front, but rather like a front with extended "fingers", due to the fact that water will always seek to find the line of least resistance in the formation. This may be compared with observations made when water is spurted onto a mound of gravel. You will soon observe that the water digs depressions where water can pass. The hazard of water injection is that such a "finger" reaches the production well. In that case only water will be produced from the injection. In order to overcome these problems much work is done to develop very sofisticated computer models of these so called front movements in order to permit control of both volume and pressure of water to prevent break-through to production wells.

A natural manner of increasing the degree of recovery would be to overcome the above mentioned binding forces with an increase of the pressure within the formations, and not with a pressure front of water or another expelling medium.

It is an object of the present invention to disclose a process for achieving this aim on the basis of comprehension of the binding forces acting in a typical oil reservoir.

The process should state the necessary elements for achieving the intended effect and the technique used to this end.

From physics it is known that the frictional force between bodies will decrease dramatically if one body is rapidly moved normally to the direction of movement of the other body. This fact is, inter alia, used when certain instruments are supported, i.e. a marker of an instrument for detecting some physical change is mounted on a slide bearing on a round rod. When said rod is rotated the frictional force between said bearing and rod will be approximately 0. The same effect may, indeed, be observed when we hit the cover of, e.g. an oil drum, if there is a little sand and water on said cover. Both sand and water will "float" on the cover like small drops, and there is only a minimum force needed to blow the drops away.

The first part of the process has the object of establishing vibrations of an oil reservoir to achieve the same effect of the oil trapped in the formations.

So long as there is a natural pressure in the reservoir this will be enough to squeeze out considerably more oil than from a reservoir "in piece and quiet". Even though a considerably lower pressure is necessary to recover more oil from the field, sooner or later, there will be a limit of how much oil you can recover from the field. When the natural pressure disappears there are two conceivable manners of recovering oil—pumping by suction, which is e.g. used in so called "nodding pumps" and/or creating a new pressure inside the reservoir.

Since there is still a considerable volume of oil remaining in the reservoir it represents a liquid which could, by evaporation, create the necessary internal pressure to increase the degree of recovery.

It is suggested that such evaporation of the oil may be achieved by heating the field by the aid of electrical high-frequency currents passing between the different wells that are commonly drilled from a production rig. Since there is always a little brine in an oil field and/or such brine can be supplied by injection and to the extent water break-through is achieved between the separate wells an electroconductive medium will be obtained which will act as an electrode furnace when electric energy is supplied. The resulting energy will cause evaporation of oil/water and will, thus, increase the pressure so that more oil can be recovered.

DETAILED DESCRIPTION OF THE INVENTION

Figure 1:
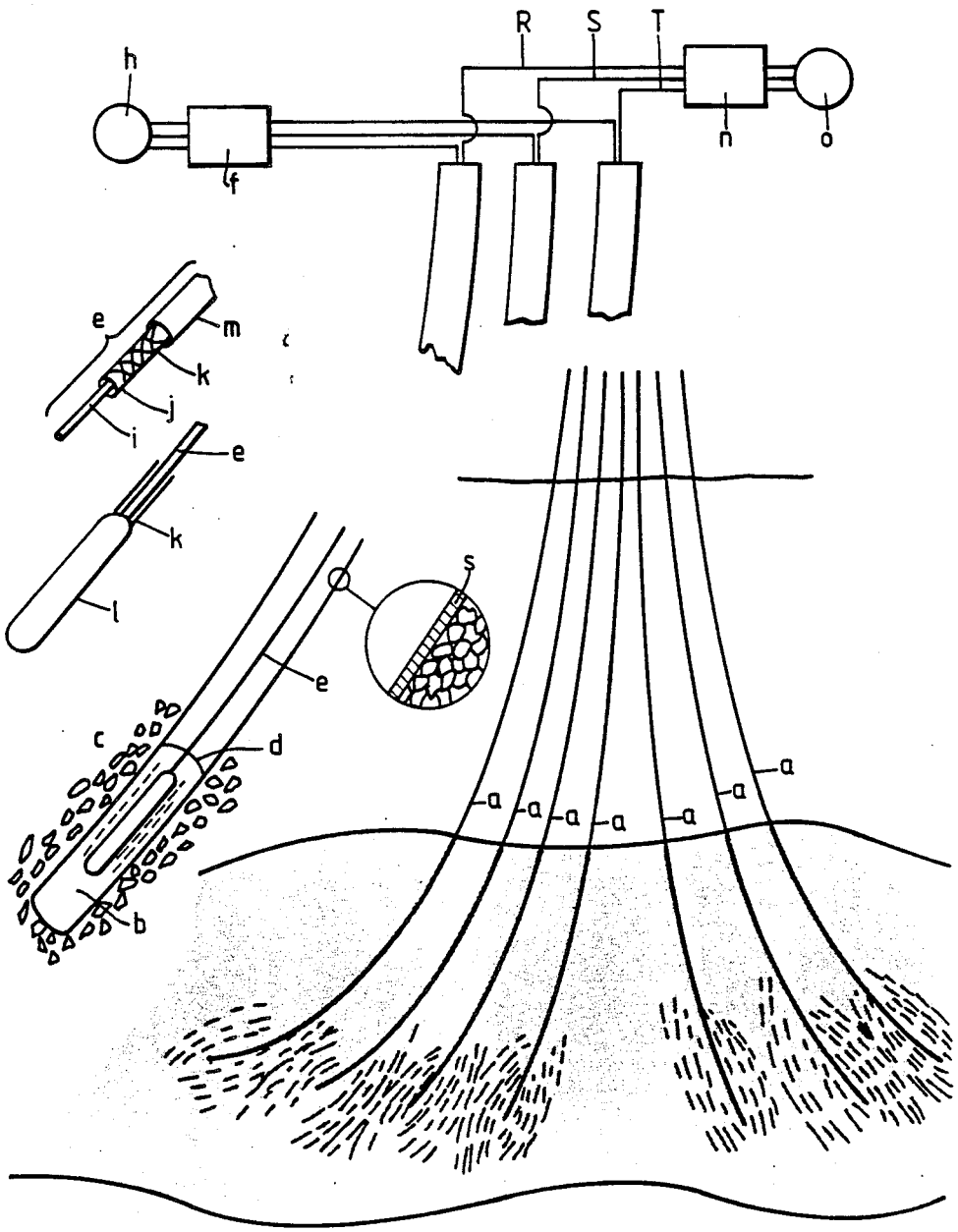
FIG. 1 shows a sectional view of several wells drilled according to the invention.

The process is now explained in more detail with reference to the drawing:

FIG. 1 shows a sectional view of an oil reservoir where several wells a have been drilled. Into the lower portion of the well, where oil recovery takes place, mercury b or another heavy electroconductive liquid was poured. The function of said liquid is both to conduct vibrations to the surrounding formations c, to conduct electric current from one well to another, and also to "flash" out oil/water, and possibly mud produced below liquid level d.

A high-frequency vibrator is via a cable e provided in liquid b and is supplied with energy from the surface by a high-frequency convertor which is, in turn supplied with energy from a generator h. This energy is conducted down to said vibrator by conductors in the center of cable e. Said conductors are surrounded by an insulator j onto which a conductor k is wound which is connected in an electroconductive manner to the surface 1 of said vibrator.

Conductor k receives energy from a high-frequency convertor n which, in turn, receives its energy from a generator o. Said generator and frequency convertor can supply both single phase and polyphase current. In case of single phase current each phase goes to a well and in case of three-phase current 3 wells are connected to phases R, S, T.

Electric current may also be conducted down to the well through pipes s made from steel or another electroconductive material conventionally used for well liners. In this case only conductors for supplying energy to the vibrator itself by the aid of conductor i are required. Liquid b, also, does not have to be electroconductive in this case.

Figure 2:
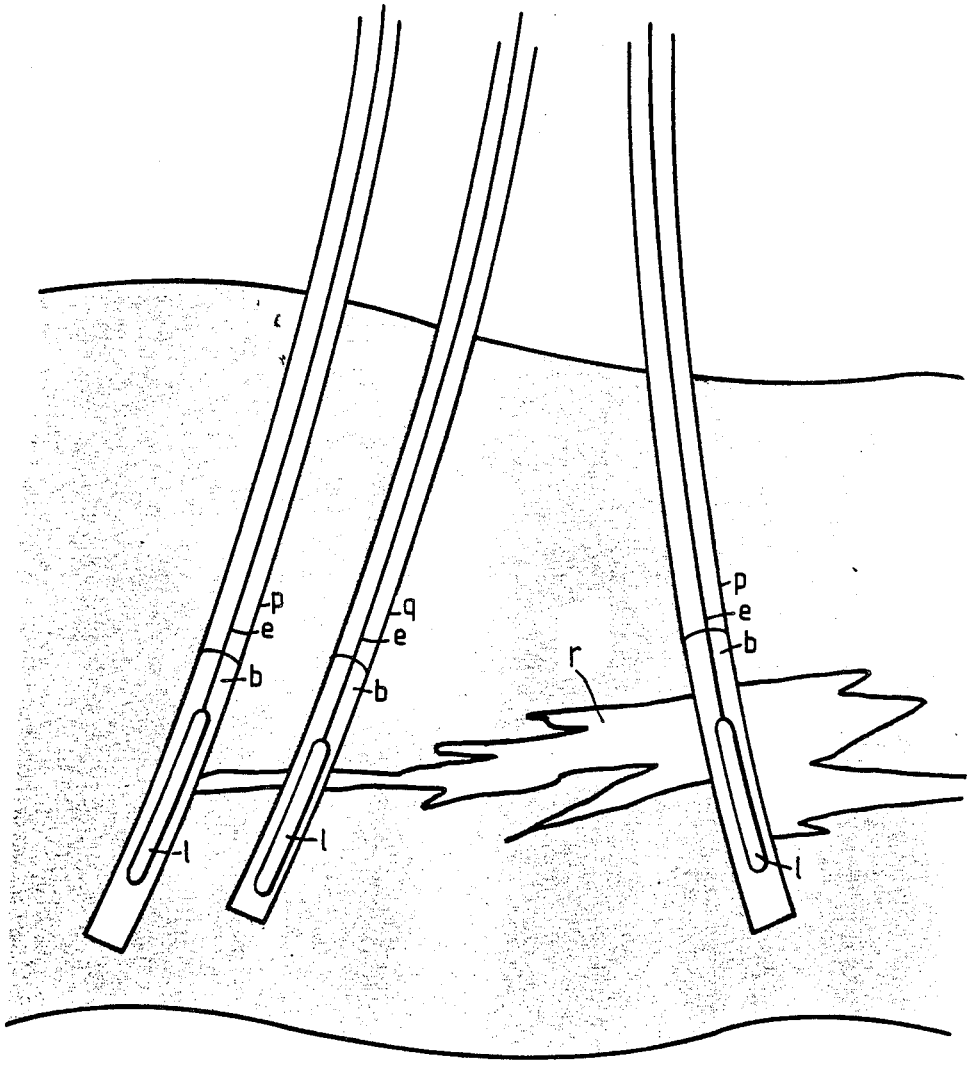
FIG. 2 is an enlarged view of the lower portion of a well according to the invention.

FIG. 2 shows an enlarged view of the lower portion of two wells p with an auxiliary well q, and an illustration of a break-through of water r.

When said vibrator receives energy it will oscillate the mercury b with vibrations adapted to the natural frequency of the formations, said natural frequency being defined as the frequency of the undamped free vibration, that will cause resonant vibrations in said formations which vibrations will propagate outwards and will, literally shake off the oil from the formations. The energy from vibrations will also supply the formations with heat as frictional heat between separate particles of the formation and between the formations and the oil flowing out, and it will contribute to maintaining the pressure by evaporating some oil and water.

When energy is supplied to the surface of vibrators it will be conducted outwards to the surrounding formations through the mercury and it will propagate further outwards in the field to next pair of poles in the next well. The same will happen if the current is conducted down into the well through the liners. Conductivity will increase if there is a break-through of water and this will, in fact, contribute to increase the development of heat in the formations. If the formations are such that it is impossible to achieve electrical contact between two production wells p so called auxiliary wells may be drilled in which the same kind of vibrators/electric conductors are provided.

Figure 3:
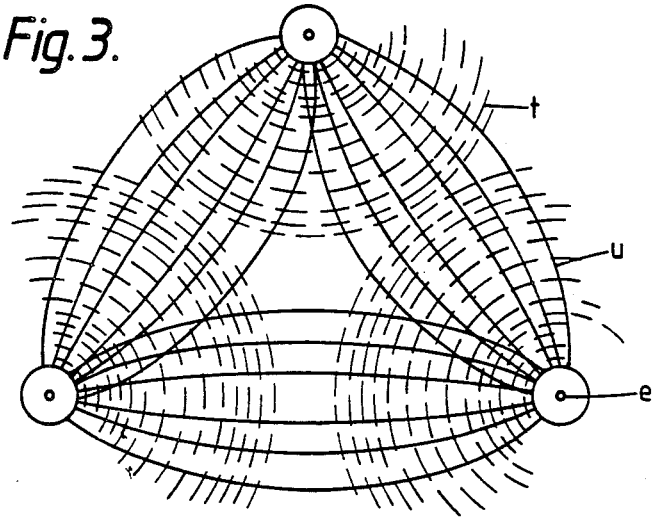
FIG. 3 is a sectional view of three wells showing vibrational and electrical waves.

FIG. 3 shows a sectional view of three wells indicating how vibrations t and the electric field u propagate between wells.

Figure 4:
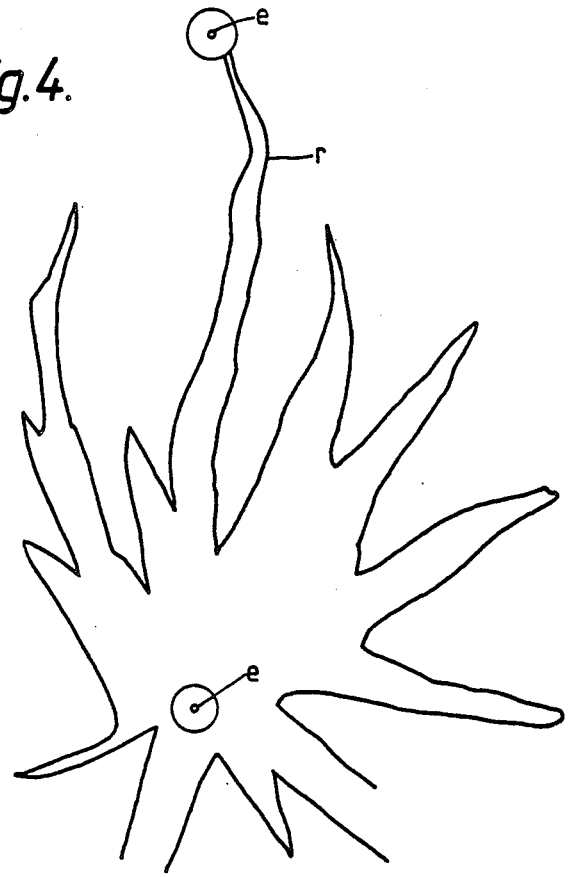
FIG. 4 is a sectional view of two wells and the "finger problems" that arise with water flooding.

FIG. 4 is a sectional view of two wells indicating the "finger problem" that may arise when water is injected.

Figure 5:
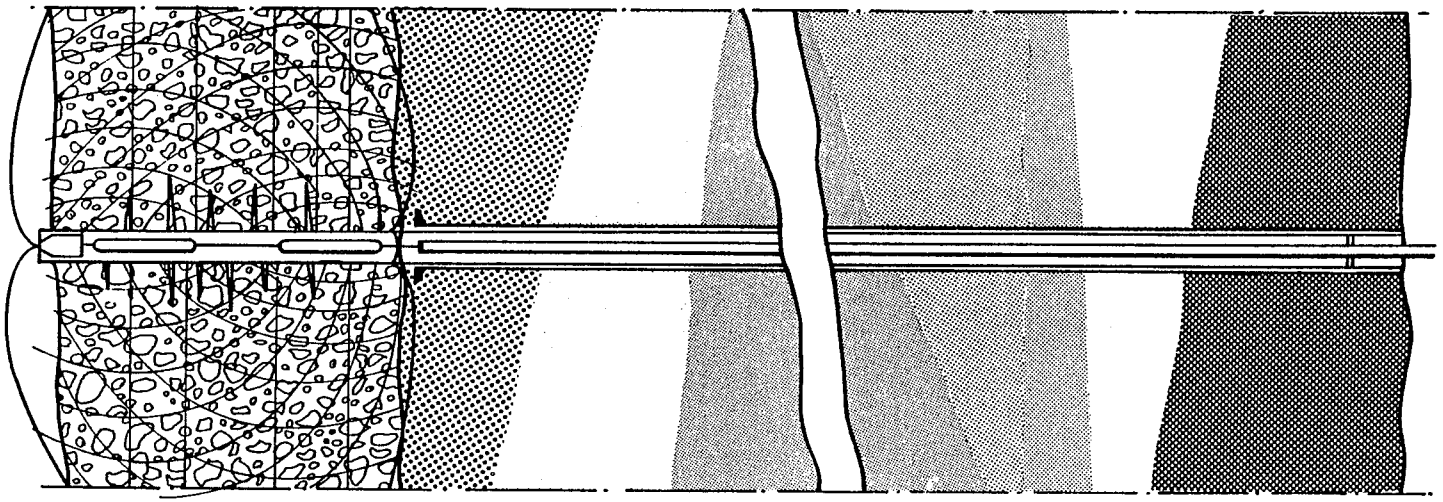
FIG. 5 is a section of a well using two vibrators.

FIG. 5 shows a section of a well illustrating an arrangement comprising two vibrators and indicating the waves of vibration and the field lines from the electric voltage going down into the mercury.

I claim:

1. A process for increasing the degree of extraction of oil or other volatile liquids in oil reservoirs on land or at sea, by making the formations in said reservoirs vibrate as close to the natural frequency of said formations as possible, so that the binding forces between the formations and oil are degraded, and by electric stimulation by means of electrodes placed in at least two adjacent well bores, the improvement comprising filling a well bore with a metallic liquid in a height zone corresponding to the height of the formation, vibrating said metallic liquid by means of an inserted vibrator, and at the same time performing an electric stimulation by applying an alternating electric current to said electrodes.

2. A process according to claim 1, in which the metallic liquid is mercury.

3. A process according to claim 1, in which more than one vibrator is used in the said well bore.

4. A process according to claim 1, in which electric current is supplied to the metallic liquid acting as an electrode.

* * * * *